US005531278A

United States Patent [19]

Lin

[11] Patent Number: 5,531,278

[45] Date of Patent: Jul. 2, 1996

[54] POWER DRILL WITH DRILL BIT UNIT CAPABLE OF PROVIDING INTERMITTENT AXIAL IMPACT

[76] Inventor: Pi-Chu Lin, No. 157-8, Hu-Tzu-Nei, Hu-Nei Li, Chia-Yi City, Taiwan

[21] Appl. No.: 499,173

[22] Filed: Jul. 7, 1995

[51] Int. Cl.[6] ..... E21C 1/12

[52] U.S. Cl. ..... 173/176; 173/13; 173/48; 173/178; 173/216

[58] Field of Search ..... 173/13, 47, 48, 173/104, 109, 114, 176, 178, 216

[56] References Cited

U.S. PATENT DOCUMENTS

| | | | |
|---|---|---|---|
| 3,710,873 | 1/1973 | Allen | 173/176 |
| 3,741,313 | 6/1973 | States | 173/176 |
| 5,209,308 | 5/1993 | Sasaki | 173/178 |
| 5,289,885 | 3/1994 | Sakoh | 173/176 X |
| 5,343,961 | 9/1994 | Ichikawa | 173/48 |
| 5,372,206 | 12/1994 | Sasaki et al. | 173/178 |
| 5,385,512 | 1/1995 | Moolenaar et al. | 173/176 X |

*Primary Examiner*—Scott A. Smith
*Assistant Examiner*—Jay A. Stelacone
*Attorney, Agent, or Firm*—Nixon & Vanderhye

[57] ABSTRACT

A power drill includes a casing, a bit-carrying shaft provided with a front toothed member, a rear toothed member fixed on the casing, a driving unit, and a speed reduction device which interconnects the driving unit and the shaft so as to rotate the shaft at a speed smaller than that of the driving unit. The speed reduction device includes a planetary gear train provided with an internal gear mounted in the casing, and a coiled compression spring which presses the internal gear against an inner wall of the casing so as to fix the internal gear in the casing. An adjustment member is mounted rotatably on the casing and cannot move axially on the casing. The compression spring is located between the internal gear and the stepped portion of the adjustment member. The adjustment member is rotatable relative to the casing so as to compress the compression spring, thereby increasing the push force of the compression spring toward the internal gear, and so as to interengage the front and rear toothed members, thereby urging the front toothed member and the shaft to move forward away from the rear toothed member and providing an impact to an object to be drilled. In use, when the drill unit rotates and when the shaft cannot rotate, the internal gear can rotate.

3 Claims, 4 Drawing Sheets

POWER DRILL WITH DRILL BIT UNIT CAPABLE OF PROVIDING INTERMITTENT AXIAL IMPACT

BACKGROUND OF THE INVENTION

1. Field of the Invention

The invention relates to a power drill, more particularly to a power drill with a drill bit unit which is capable of providing intermittent axial impact during a drilling Operation thereof.

2. Description of the Related Art

A conventional power drill includes generally a drill bit unit, a driving unit for rotating the drill bit unit, and a speed reduction device which interconnects the driving unit and the drill bit unit so that the drill bit unit rotates at a speed smaller than that of the driving unit when the latter is actuated. In use, rotation of the drill bit unit of the conventional power drill may stop when an object which provides a retarding force that is greater than the torque of the drill bit unit is encountered. In this case, continued drilling operation of the drill on said object may ruin the conventional power drill because the torsion of the drill bit unit cannot be adjusted to overcome the retarding force. In some cases, it is necessary for the drill to pound the object in an axial direction of the drill bit unit during the drilling operation.

SUMMARY OF THE INVENTION

Therefore, the object of the present invention is to provide a power drill with a drill bit unit whose torsion can be varied so as to comply with the requirement of an object to be drilled and which can provide intermittent impact during the drilling operation thereof.

Accordingly, the power drill of the present invention includes a handle unit, a casing connected securely to the handle unit, a drill bit unit which has a bit-carrying shaft provided with a front toothed member, a rear toothed member fixed on a front end portion of the casing and spaced apart from the front toothed member, a driving unit for rotating the bit-carrying shaft, and a speed reduction device which interconnects the driving unit and the shaft so that the shaft rotates at a speed smaller than that of the driving unit. The speed reduction device includes a planetary gear train provided with an internal gear and mounted in the casing, and a coiled compression spring which presses the internal gear against an inner wall of the casing so as to fix the internal gear in the casing. An adjustment member is mounted rotatably on the front end portion of the casing in such a manner that axial movement of the adjustment member relative to the casing is prevented. The adjustment member includes a circumferentially stepped portion which is arranged so as to position the compression spring between the internal gear and the stepped portion.

The adjustment member is rotatable relative to the casing so as to compress the compression spring, thereby increasing the push force of the compression spring toward the internal gear, and so as to interengage the front and rear toothed members, thereby urging the front toothed member and the shaft to move forwards away from the rear toothed member. Forward movement of the shaft away from the rear toothed member and from the casing provides an axial impact to an object which is to be drilled.

The power drill according to the present invention can drill an object in a known manner. In the event that the object being drilled causes a retarding force which is greater than the torque of the drill bit unit, the latter stops rotating and enables the internal gear to rotate against the push action of the compression spring so as to prevent ruin of the driving unit of the power drill. The cylindrical body can be rotated relative to the casing so as to compress the compression spring, thereby increasing the push force on the internal gear such that the drill bit unit provides intermittent axial impact to overcome the retarding force of the drilled object.

BRIEF DESCRIPTION OF THE DRAWINGS

Other features and advantages of the present invention will become more apparent in the following detailed description of the preferred embodiment with reference to the accompanying drawings, in which.

DETAILED DESCRIPTION OF THE PREFERRED EMBODIMENT

Figure 1:
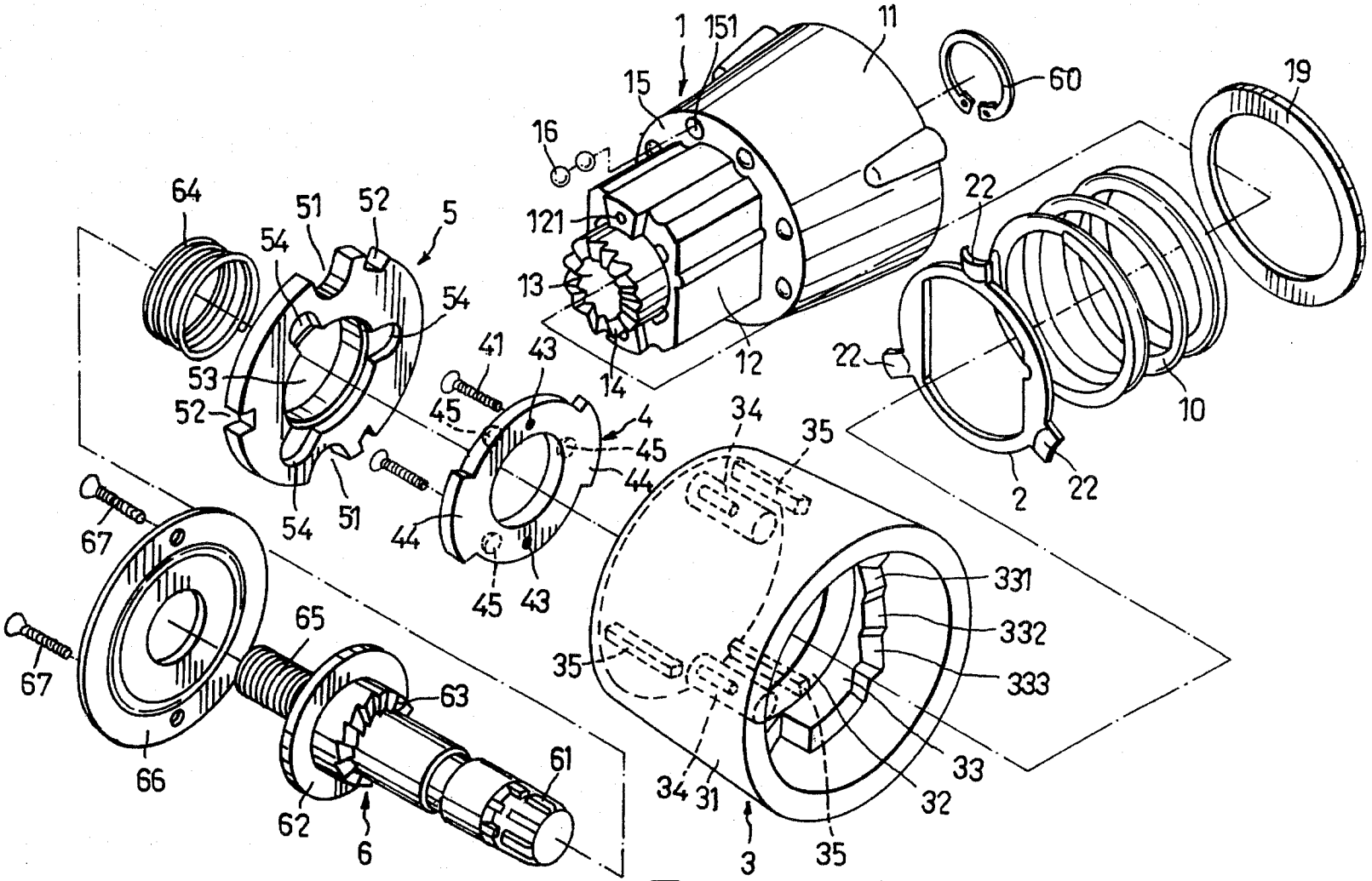
FIG. 1 is an exploded view of a power drill of the present invention.
Figure 3:
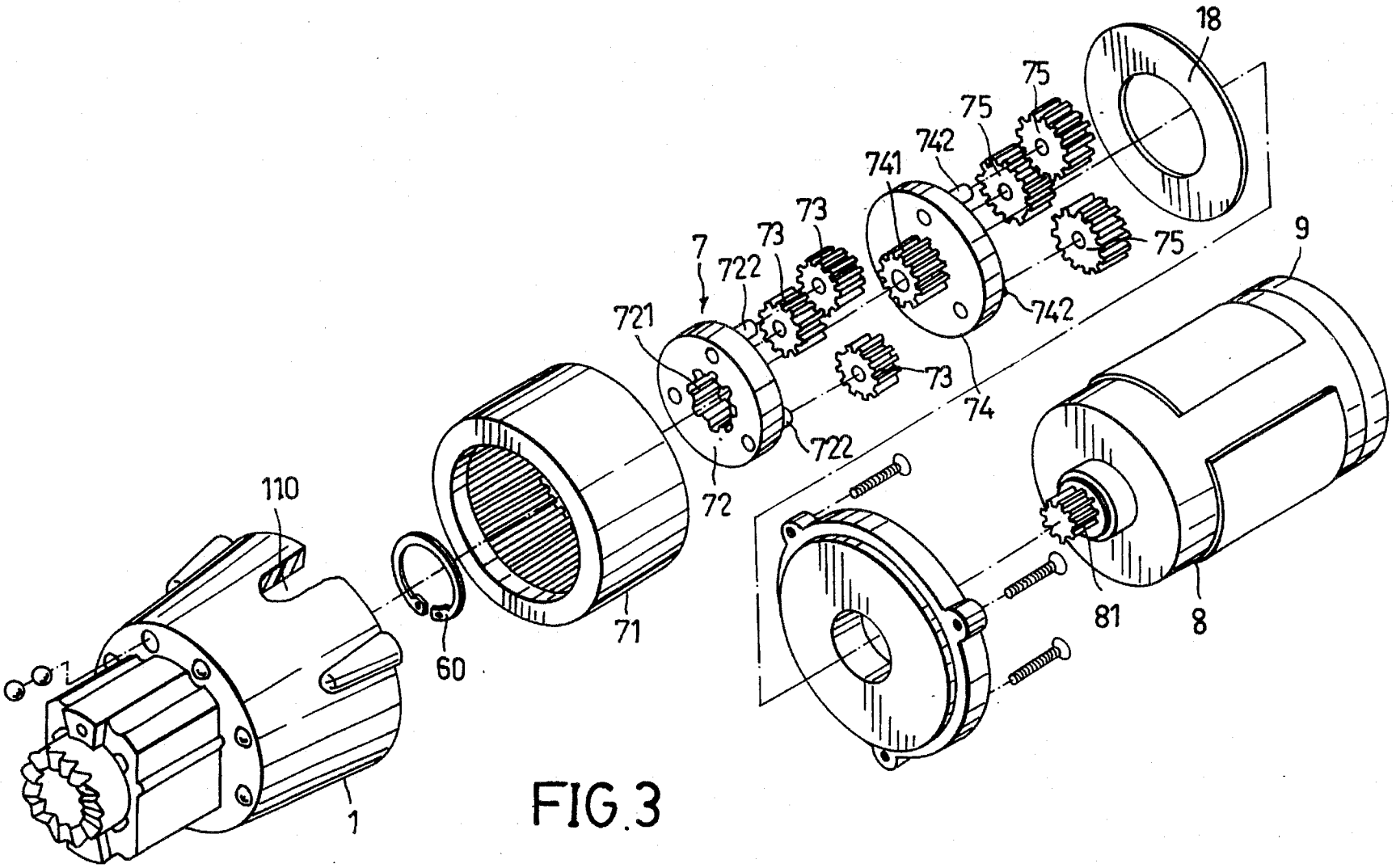
FIG. 3 is an exploded view showing the speed reduction device of the power drill of the present invention.

Referring to FIGS. 1 and 3, a power drill of the present invention is shown to comprise a casing 1, an adjustment member 3, a drill bit unit, a speed reduction device 7, a driving unit 8, and a coiled compression spring 10.

The casing 1 is connected securely to a handle assembly 9 with a handle (not shown) and includes a hollow cylindrical rear portion 11 formed with a rear chamber 110 (see FIG. 2), and a constricted front portion 12 having a rear toothed member 14 with a plurality of annularly arranged and axially extending teeth. A shoulder 15 is defined between the front and rear portions 11, 12. A plurality of axially extending channels 151 are formed through the shoulder 15 and are communicated with the rear chamber 110 so as to receive a plurality of pressing balls 16 therein. The front portion 12 of the casing 1 has a central bore 13 formed therethrough and communicated with the rear chamber 110.

Figure 2:
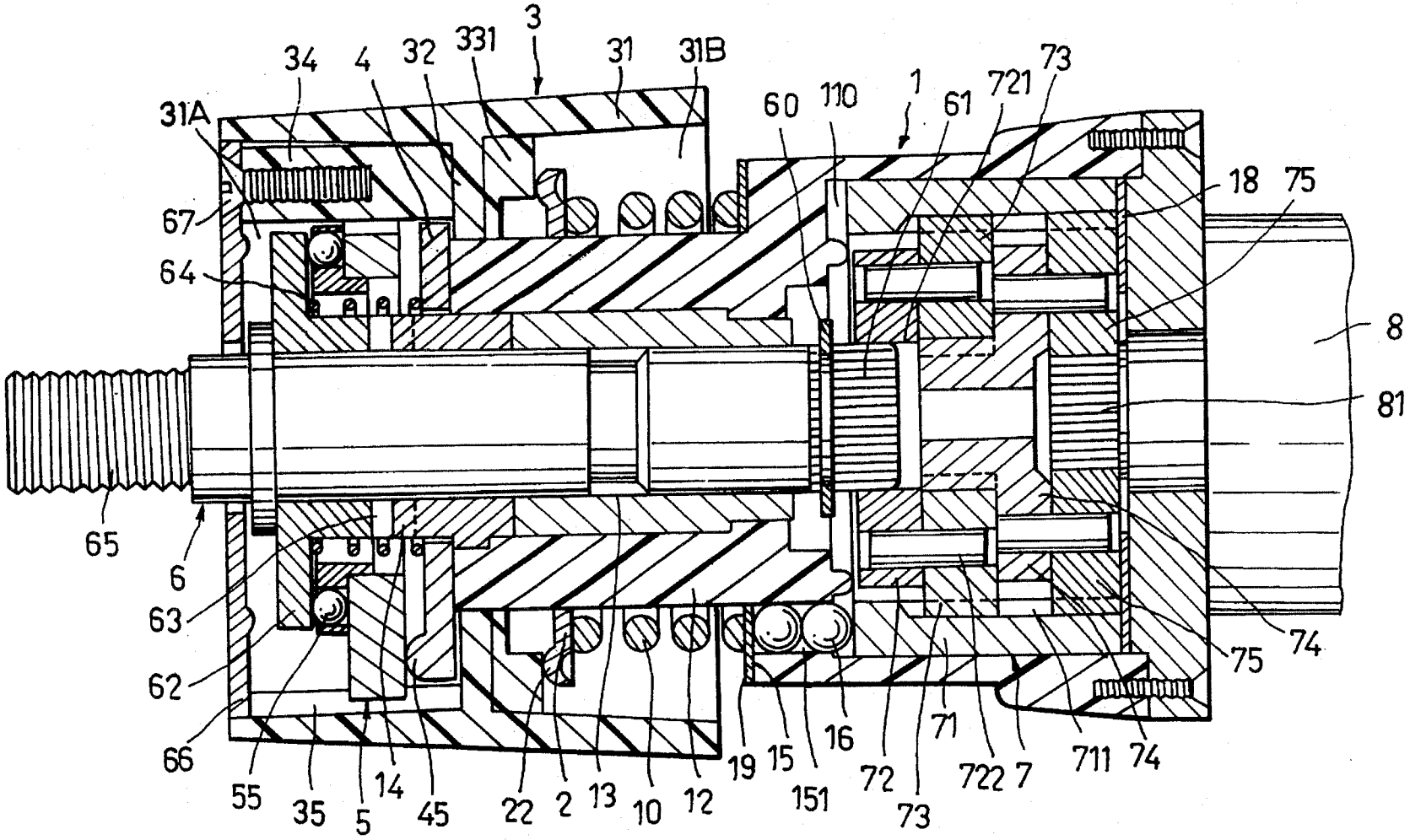
FIG. 2 is a sectional view of the power drill of the present invention, illustrating the interior structure of the power drill before the total length of a compression spring is compressed.

Referring to FIGS. 2 and 3, the driving unit 8 is coupled with the front end of the handle assembly 9 and includes an externally splined driving shaft 81. The speed reduction device 7 includes a planetary gear train which has an internal gear 71 mounted in the rear chamber 110 of the casing 1, a first planet carrier 72 mounted rotatably in the internal gear 71, a first set of planet gears 73 mounted rotatably on the fixed shafts 722 of the carrier 72 and meshing with the internal gear 71, a second planet carrier 74 formed with an externally splined portion 741 that meshes with the planet gears 73, and a second set of planet gears 75 mounted rotatably on the fixed shafts 742 of the carrier 74. The splined driving shaft 81 of the driving unit 8 extends into the rear chamber 110 of the casing 1 and meshes with the planet gears 75 of the speed reduction device 7 so that the bit-carrying shaft 6 rotates at a speed smaller than that of the driving unit 8.

The drill bit unit is disposed through the central bore 13 of the casing 1 and includes a bit-carrying shaft 6 having a fixed front toothed member 63 provided with a plurality of annularly arranged and axially extending teeth, and an externally splined rear end portion 61 which engages the internally splined section 721 of the carrier 72. A retaining ring 60 is engaged within an annular groove that is formed in the rear end portion 61 of the shaft 6 and abuts on the wall of the rear chamber 110 so as to prevent removal of the shaft 6 from the casing 1.

The adjustment member 3 includes a hollow cylindrical body 31 which has a radially extending inward flange 32 disposed rotatably around the front portion 12 of the casing 1 so as to divide the cylindrical body 31 into a front section.31A and a rear section 31B which are located on two sides of the flange 32. The rear section 31B of the cylindrical body 31 has three stepped portions 33 (only one is shown in FIG. 1), each of which is provided with a low section 331, a middle section 332 and a high section 333.

The adjustment member 3 further includes an annular positioning disc 4 and an annular adjustable disc disposed within the front section 31A of the cylindrical body 31 around the shaft 6. A pair of fastening screws 41 extend through the holes 43 of the disc 4 and are threaded in the holes 121 of the front end portion 12 of the casing 1, thereby retaining the adjustment member 3 on the casing 1 and the positioning disc 4 on the front portion 12 of the casing 1 in such a manner that the rear toothed member 14 of the casing 1 extends into the front section 31A of the cylindrical casing 31 via the central hole of the positioning disc 4. The positioning disc 4 includes a disc body 44 and three frontwardly extending tongues 45 extending from the disc body 44. The adjustable disc 5 is adjacent to the positioning disc 4 and has a pair of diametrically opposed peripheral notches 51, three spaced engaging peripheral grooves 52, and three receiving recesses 54 formed in a side surface thereof; Two locking screws 67 extend through an annular cover 66 and are threaded to the internally threaded posts 34 of the cylindrical body 31 in such a manner that the front threaded portion 65 of the shaft 6 extends from the front section 31A of the cylindrical body 31 while the posts 34 and the rods 35 of the adjustment member 3 engage within the peripheral notches 51 and the grooves 52 of the adjustable disc 5 so that the adjustable disc 5 rotates synchronously with the cylindrical body 31. Under this condition, the disc body 53 of the adjustable disc 5 contacts slidably the tongues 45 of the positioning disc 4 and thus stagger the receiving recesses 54 relative to the tongues 45. A spring unit 64 is provided around the front toothed member 63 of the shaft 6 between the positioning disc 4 and an outward flange 62 of the shaft 6 so as to bias the outward flange 62 away from the positioning disc 4 to abut against the cover 66. At this time, the front toothed member 63 of the shaft 6 extends into the disc body 53 but does not mesh with the rear toothed member 14 of the casing 1.

A coiled compression spring 10 is sleeved around the front end portion 12 of the casing 1 between the stepped portion 33 of the cylindrical body 31 and a washer 19 which is also sleeved around the front portion 12 of the casing 1 and which abuts against the balls 16 so that the washer 19 and the balls 16 are biased by the compression spring 10 to press the internal gear 71 against the rear inner wall 18 of the chamber 110, thereby fixing the internal gear 71 in the rear chamber 110. Thus, axial movement of the cylindrical body 31 on the casing 1 is prevented.

When the driving unit 8 is actuated, the planet gears 73, 75 revolve on the internal gear 71 and on the carriers 72, 74 so as to drive the bit-carrying shaft 6. The second planet carrier 74 rotates at a speed smaller than that of the driving shaft 81 of the driving unit 8. The first planet carrier 72 rotates at a speed smaller than that of the second planet carrier 74. In case that the drill bit unit of the power drill according to the present invention encounters an object which provides a retarding force that is greater than the torque of the drill bit unit, the drill bit unit and the first planet carrier 72 stop rotating. At this time, the planet gears 73, 75 keep on rotating on the carriers 72, 74 so as to rotate the internal gear 71 against the push action of the compression spring 10, thereby avoiding damage to the driving unit 8. Note that a bearing unit 55 is disposed between the outward flange 62 of the shaft 6 and the adjustable disc 5 to facilitate rotation of the shaft 6 relative to the cylindrical body 31.

Figure 4:
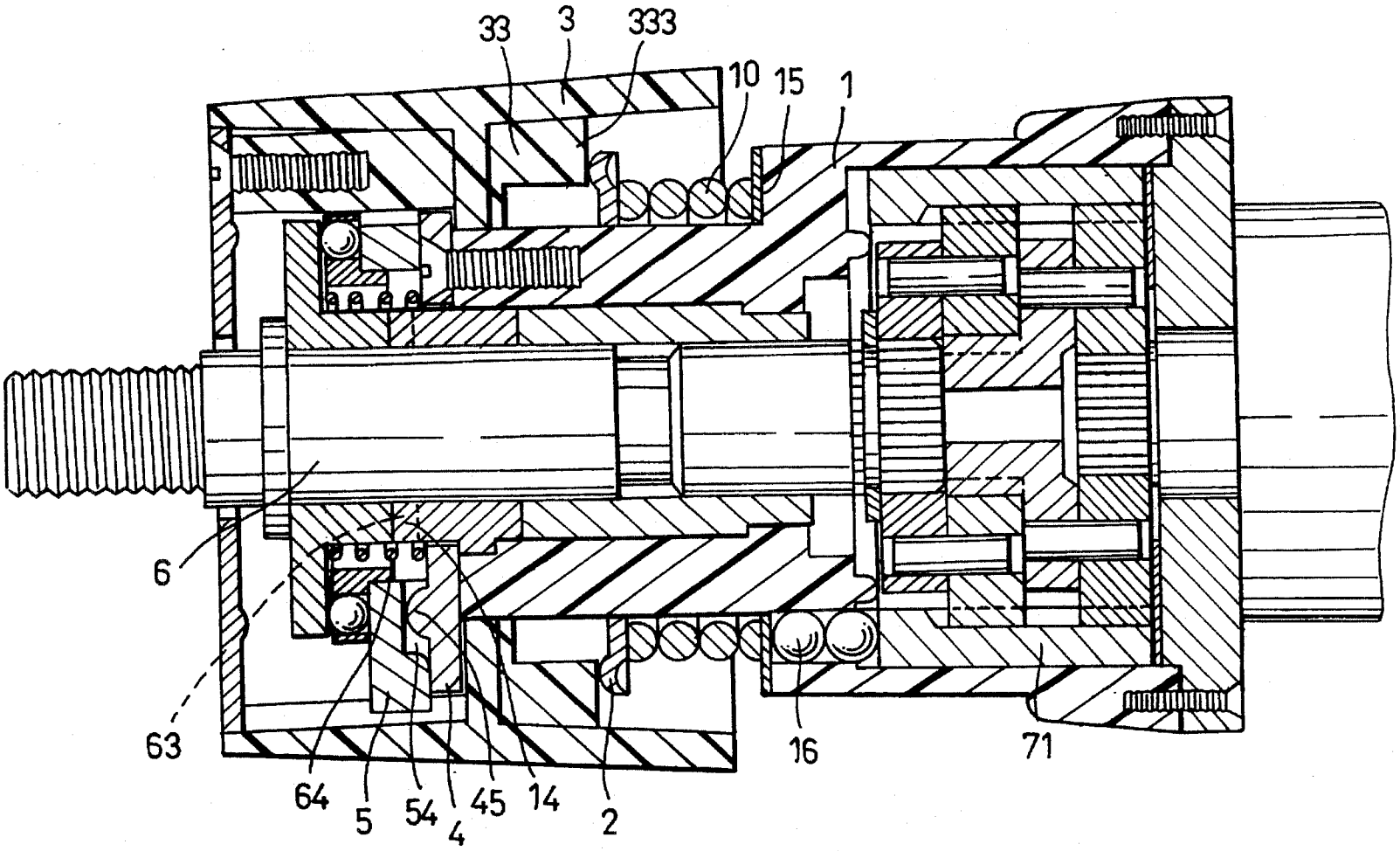
FIG. 4 is a sectional view of the power drill of the present invention, illustrating the interior structure of the power drill after a compression spring is adjusted.

Referring to FIG. 4, the cylindrical body 31 is rotated relative to the casing 1 so as to engage the tongues 45 of the positioning disc 4 in the recesses 54 of the adjustable disc 5, thus compressing the spring unit 64 and interengaging the front and rear toothed members 63, 14. Compression of the spring unit 64 can assist in the forward movement of the shaft 6 away from the casing 1. At the same time, the compression spring 10 is also compressed because of shifting of the protrusions 22 of a pressing ring 2, which are pushed toward the stepped portion 33 of the adjustment member 3 by the compression spring 10, from the lower sections 331 to the high sections 333, thereby increasing the push force of the compression spring 10 toward the internal gear 71. In this case, upon actuation of the driving unit 8, the drill bit unit rotates with intermittent impact to drill the object. The drill bit unit provides intermittent axial impact to overcome the retarding force during the drilling operation thereof. Accordingly, the power drill of the present invention provides high-efficiency performance when compared to that of the conventional power drill.

With the present invention thus explained, it is obvious to those skilled in the art that various modifications and variations can be made without departing from the scope and spirit thereof. It is therefore intended that the present invention be limited only as in the appended claims.

I claim:

1. A power drill comprising:

a handle assembly;

a casing connected securely to said handle unit;

a drill bit unit having a bit-carrying shaft provided with a front toothed member which includes a plurality of axially extending teeth that are arranged annularly on said shaft;

a rear toothed member fixed on said casing and spaced apart from said front toothed member;

a rotatable driving unit rotating said bit-carrying shaft;

a speed reduction device interconnecting said driving unit and said shaft so that said shaft rotates at a speed smaller than that of said driving unit, said speed reduction device including a planetary gear train provided with an internal gear mounted in said casing;

a coiled compression spring pressing said internal gear against an inner wall of said casing so as to fix said internal gear in said casing; and an adjustment member mounted rotatably on said casing in such a manner that axial movement of said adjustment member relative to said casing is prevented, said adjustment member including a circumferentially stepped portion which is arranged so as to position said compression spring between said internal gear and said stepped portion, said adjustment member being rotatable relative to said casing so as to reduce total length of said compression spring, thereby increasing push force of said compression spring toward said internal gear, and so as to interengage said front and rear toothed members, thereby urging said front toothed member and said shaft to move forward away from said rear toothed member, forward movement of said shaft away from said rear toothed member and from said casing being capable of providing an impact to a workpiece to be drilled, said compression spring providing a push action on said internal gear so as to enable rotation of said internal gear when said driving unit rotates and when said shaft cannot rotate, thereby avoiding damage to said drill.

2. The power drill as defined in claim 1, wherein said casing includes a hollow cylindrical rear portion formed with a rear chamber which receives said internal gear therein, and a constricted front portion, thereby defining a shoulder between said front and rear portions, said casing further having an axially extending channel which is formed through said shoulder and which is communicated with said rear chamber so as to receive in said channel a pressing ball that abuts said internal gear, and a central bore that is formed through said front portion and that is communicated with said rear chamber, said adjustment member including a washer which is sleeved around said front portion of said casing and which abuts against said pressing ball so that said washer and said pressing ball are biased by said compression spring to press against said internal gear, said bit-carrying shaft extending through said bore and having a rear distal end portion projecting into said rear chamber, said planetary gear train including a planet carrier provided in said internal gear and connected securely to said rear distal end portion of said shaft, and a set of planet gears mounted rotatably on said planet carrier and meshing with said internal gear;

whereby, when said driving unit is actuated, said planet gears revolve on said internal gear so as to drive said bit-carrying shaft.

3. The power drill as defined in claim 2, wherein said adjustment member includes a hollow cylindrical body which has a radially extending inward flange located around said front portion of said casing, thereby dividing said cylindrical body into a front section and a rear section which are located on two sides of said inward flange, said stepped portion being located in said rear section, said adjustment member further including an annular positioning disc disposed within said front section of said cylindrical body around said shaft and connected securely to said casing in such a manner that said rear toothed member of said casing extends into said front section of said cylindrical body via said positioning disc, and an annular adjustable disc provided around said shaft and connected securely to said cylindrical body, one of said positioning disc and said adjustable disc being provided with a plurality of frontwardly extending tongues, the other one of said positioning disc and said adjustable disc contacting slidably said tongues and having a plurality of receiving recesses being of a number corresponding to said tongues and being staggered relative to said tongues, said front toothed member of said shaft extending through said adjustable disc and having a radially extending outward flange disposed adjacent to said adjustable disc, a spring unit being provided around said front tooth member of said shaft between said positioning disc and said outward flange so as to bias said outward flange to move forward away from said positioning disc;

said cylindrical body being capable of being rotated relative to said casing so as to engage said tongues in said recesses and so as to mesh said front and rear toothed members, thereby compressing said spring unit and interengaging said front and rear toothed members, whereby compression of said spring unit can assist in the forward movement of said shaft away from said casing.

* * * * *